US011361919B2

(12) United States Patent
Hegger et al.

(10) Patent No.: US 11,361,919 B2
(45) Date of Patent: Jun. 14, 2022

(54) SWITCH DEVICE WITH AT LEAST ONE ELECTRIC SWITCH ELEMENT AND A CAMSHAFT

(71) Applicant: STEUTE TECHNOLOGIES GMBH & CO. KG, Löhne (DE)

(72) Inventors: Christof Hegger, Porta Westfalica (DE); Uwe Röbke, Porta Westfalica (DE)

(73) Assignee: STEUTE TECHNOLOGIES GMBH & CO. KG, Löhne (DE)

( * ) Notice: Subject to any disclaimer, the term of this patent is extended or adjusted under 35 U.S.C. 154(b) by 0 days.

(21) Appl. No.: 16/766,372

(22) PCT Filed: Nov. 19, 2018

(86) PCT No.: PCT/EP2018/081768
§ 371 (c)(1),
(2) Date: May 22, 2020

(87) PCT Pub. No.: WO2019/101687
PCT Pub. Date: May 31, 2019

(65) Prior Publication Data

US 2020/0381197 A1 Dec. 3, 2020

(30) Foreign Application Priority Data

Nov. 23, 2017 (DE) ..... 20 2017 107 118.9
Jun. 8, 2018 (DE) ..... 20 2018 103 237.2

(51) Int. Cl.
*H01H 15/10* (2006.01)
*H01H 19/62* (2006.01)

(52) U.S. Cl.
CPC ..... *H01H 15/105* (2013.01); *H01H 19/623* (2013.01)

(58) Field of Classification Search
CPC ..... H01H 13/18; H01H 19/62; H01H 9/0207; H01H 13/186; H01H 19/18; H01H 19/623;
(Continued)

(56) References Cited

U.S. PATENT DOCUMENTS 3,094,602 A 6/1963 Frachon
3,612,800 A 10/1971 Slopa
(Continued)

FOREIGN PATENT DOCUMENTS

CN 103762106 A 4/2014
CN 104124093 A 10/2014
(Continued)

OTHER PUBLICATIONS

International Search Report dated Jan. 29, 2019 in related/corresponding International Application No. PCT/EP2018/081768.
(Continued)

*Primary Examiner* — Ahmed M Saeed
(74) *Attorney, Agent, or Firm* — Patent Portfolio Builders PLLC

(57) ABSTRACT

A switch device includes at least one switch element actuated by a cam of a camshaft. The cam is a three-dimensional cam and the at least one switch element is arranged so as to be displaceable substantially parallel to an axis of the camshaft in order to adjust a switch point.

14 Claims, 7 Drawing Sheets

(58) Field of Classification Search
CPC ..... H01H 2221/032; H01H 43/125; H01H 15/10–24; H01H 15/105; H01H 15/107
See application file for complete search history.

(56) References Cited

U.S. PATENT DOCUMENTS

| | | | | |
|---|---|---|---|---|
| 3,770,924 | A | 11/1973 | Hippie et al. | |
| 3,971,904 | A * | 7/1976 | Ward | F24C 3/103 200/6 BB |
| 3,980,852 | A * | 9/1976 | Redfield | H01H 9/0207 200/574 |
| 5,552,570 | A * | 9/1996 | Shinohara | H01H 21/285 200/47 |
| 9,440,619 | B2 | 9/2016 | Sugihara | |
| 10,134,544 | B2 | 11/2018 | Barenghi | |

FOREIGN PATENT DOCUMENTS

| | | | |
|---|---|---|---|
| CN | 107004523 | A | 8/2017 |
| DE | 1102240 | B | 3/1961 |
| DE | 1176236 | B | 8/1964 |
| DE | 1901057 | U | 9/1964 |
| DE | 1241893 | B | 6/1967 |
| DE | 1281533 | B | 10/1968 |
| DE | 6906848 | U | 6/1969 |
| DE | 1765279 | A1 | 7/1971 |
| DE | 2119824 | A1 | 12/1971 |
| DE | 3722036 | A1 | 1/1989 |
| JP | 5279855 | B2 | 9/2013 |

OTHER PUBLICATIONS

Search Report created on Mar. 15, 2019 in related/corresponding DE Application No. 20 2018 103 237.2.
Search Report created on Sep. 12, 2018 in related/corresponding DE Application No. 20 2017 107 118.9.
Written Opinion dated Jan. 29, 2019 in related/corresponding International Application No. PCT/EP2018/081768.
Office Action dated Dec. 31, 2021 in related/corresponding CN Application No. 201880075725.3.

* cited by examiner

SWITCH DEVICE WITH AT LEAST ONE ELECTRIC SWITCH ELEMENT AND A CAMSHAFT

BACKGROUND AND SUMMARY OF THE INVENTION

Exemplary embodiments of the invention relate to an electric switch device with at least one switch element actuated by a cam of a camshaft. In particular, exemplary embodiments of the invention relate to such a switch device in which the camshaft is coupled to a lever or a lever-like control element for actuating the switch device, for example a belt misalignment switch.

Camshafts are found in large numbers in valve trains of internal combustion engines. The use of so-called three-dimensional cams is known, where the opening and closing behavior of the valve is influenced by changing the position of the point of action of the valve on the three-dimensional cam parallel to the camshaft axis. Either the camshaft is moved along its axis or intermediate elements, such as drag levers or rocker arms, are moved.

Furthermore, camshafts are often used in lever-operated switching systems. Here, an actuating lever is usually attached to a control shaft designed as a camshaft, which has cams via which one or more switches are actuated directly or indirectly depending on the angle of rotation of the shaft. A rough basic adjustment of the switch points is carried out by the fitter using the mounting bracket of the lever on the camshaft. Fine adjustment, on the other hand, is carried out by means of measures in the effective distance between the cam and the actuating element.

The printed publication JP 5279855 B2 describes a switch device with a trip cam having an outer cam part that is rotatable via a setting thread engaging in a counter thread of an inner cam part, which is rigid relative to the camshaft or is formed integrally with it. The disadvantage here is always the components that are difficult to assemble.

The printed publication DE1241893 B describes a switch device with a trip cam with different circumferential steps in the axial direction of a camshaft for actuating two switch elements via coaxially arranged transmission elements. The switching process is effected by rotating and/or axially shifting the camshaft with fixed switch elements. The coaxially arranged transmission elements are absolutely necessary here, an adjustability with regard to the switch points is not described. Furthermore, it is a switch device for limiting the function of a device with a jib that can be pivoted about a vertical and a horizontal axis, for example a crane.

According to the printed publication U.S. Pat. No. 3,770,924 A, the adjustment of a switch point is carried out by two elements of a drag lever arranged between camshaft and switch element. A disadvantage here are the numerous components that are difficult to assemble.

The switch device described in the printed publication DE 6906848 U has an adjustment facility when the switch housing is closed, but this is elaborately designed and is susceptible to jamming due to a curved sliding guide of a ring-segment-like element to be adjusted.

Accordingly, exemplary embodiments of the invention are directed to a switch device with easy adjustability of the switch points of the switches, which is operationally reliable, consists of few components and is easy to install.

A switch device according to the invention is characterized in that the cam is designed as a three-dimensional cam and in that the at least one switch element is arranged so as to be displaceable substantially parallel to an axis of the camshaft in order to adjust a switch point.

With a three-dimensional cam, the cross-section of the cam changes in the axial direction of the camshaft. The switch point, also called the switch threshold, of the at least one switch element can be varied by changing the position of the switch element along the axis of the camshaft. The camshaft is advantageously fixed in its axial position. The solution described can also be implemented for switch devices with several switch elements, whose position can then be changed individually or together.

In an advantageous embodiment of the switch device, the at least one switch element is supported on a carriage that allows for displacement parallel to the axis of the camshaft or is integrally connected to it. The carriage is guided in the axial direction, i.e., it can be moved along the axial direction of the camshaft. If there are at least two switch elements, these can be assigned to different carriages in order to be able to adjust the switch points of the switch elements independently of each other.

A further development of the solution provides for an adjustment possibility outside a common housing accommodating the camshaft and at least one switch element. This is advantageous if it should be possible to adjust or readjust the switch points, e.g., also during operation of the switch device, without having to open the housing of the switch device.

For this purpose, adjusting devices can be arranged in the housing, by means of which the switch point or switch points can be adjusted directly or indirectly from outside. In one embodiment, the adjusting means are one or more adjusting shafts mounted in the housing and guided at least at one end through an opening in a housing wall, aligned substantially parallel to the axis of the camshaft and each provided with a thread or a thread-like contour. The contour is in engagement with a corresponding counter-contour in the respective carriage, so that turning the respective adjusting shaft causes the associated carriage to be displaced.

In another advantageous embodiment of the switch device, the at least one switch element is fixed in a detachable latching manner after the switch point has been set. This can be achieved, for example, in that the carriage is designed as a latching carriage, which allows the shifting essentially parallel to the axis of the camshaft and the releasable latching fixing. For this purpose, the carriage can have a latching element that engages in a corresponding counter-contour. The latching element can be formed by a toothing which is referred to below as carriage toothing. The switch points can thus be adjusted easily and optionally without tools by moving the carriages and engaging them in the desired switching position. It can also be provided that the carriage itself can be mounted in and removed from the switch device without tools. The carriage can also preferably be designed in one piece, wherein the latching element and guide means in particular are integrally formed.

In another advantageous embodiment, the switch device has a scale for reading the expected switch point. The scale can serve as an adjustment aid for the switch point.

Embodiments of the invention can be advantageously used, for example, in lever-operated switches, in particular belt misalignment switches. Preferably, a lever, in particular a roller lever, is coupled non-rotatably to the camshaft for actuating the lever-operated switch.

BRIEF DESCRIPTION OF THE DRAWING FIGURES

In the following, the invention is explained in more detail by means of embodiment examples shown in the figures, wherein.

DETAILED DESCRIPTION

Only the components relevant to the invention are shown in the figures. Other components that usually belong to a belt misalignment switch, e.g., housing cover, latching and reset mechanisms, are not shown for the sake of clarity.

Figure 1:
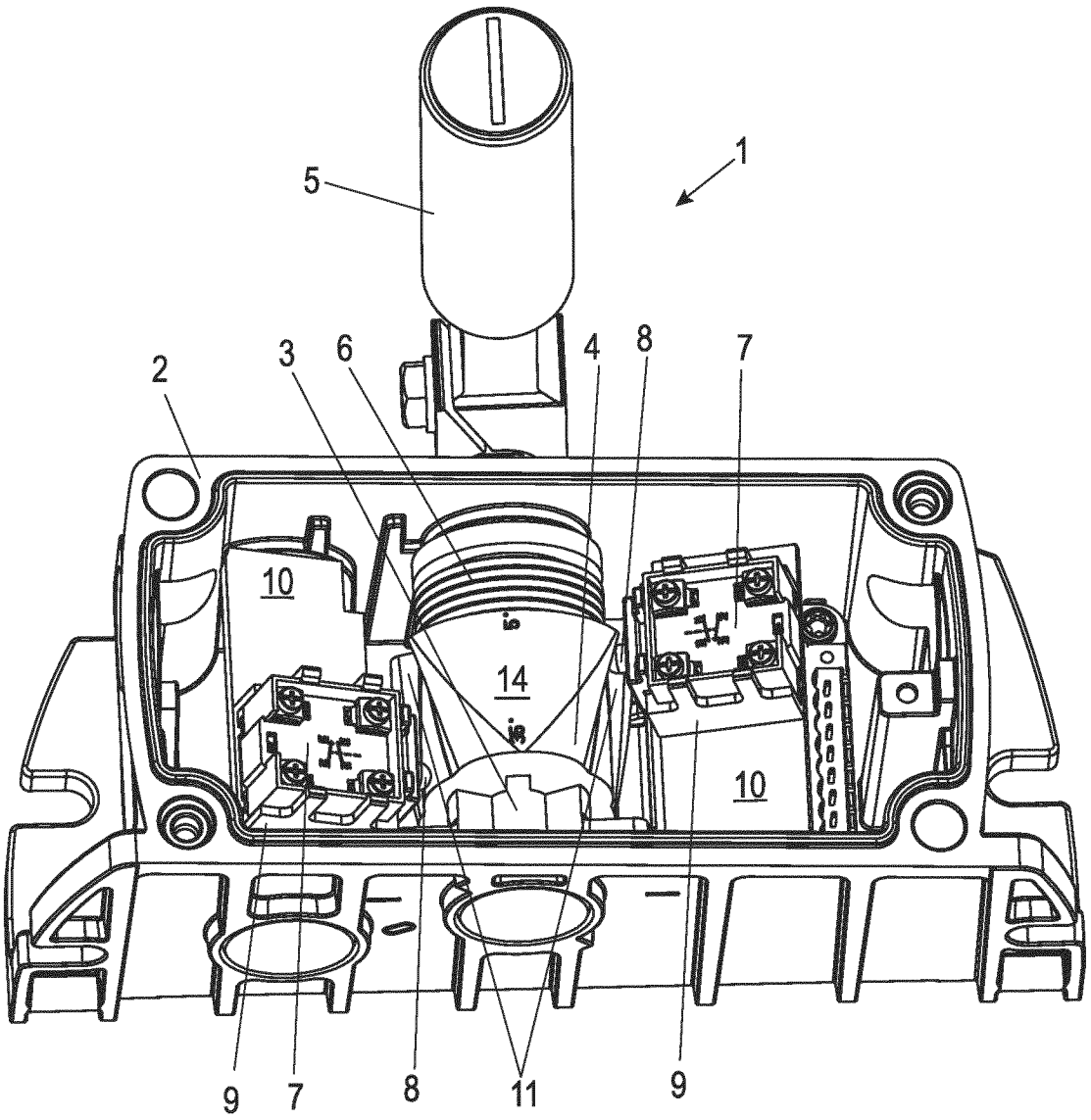
FIG. 1 shows a belt misalignment switch in a first embodiment example of the invention without adjustment possibility from outside.

FIG. 1 shows a belt misalignment switch 1 as an example of a switch device with a housing 2. A camshaft 3 is rotatably mounted in this housing with a three-dimensional cam 4, which is fixed to it or is integral with it. A roller lever 5 is connected to the camshaft 3, which actuates the camshaft 3 in the direction of rotation against the force of a return spring 6.

One or more switch elements 7 are arranged next to the camshaft 3, each with an actuating element 8 facing the camshaft 3. The switch elements 7 shown here are, for example, common microswitches, which have tappets as actuating elements 8. However, any other type of switch element, for example contactlessly operating switch elements or switch elements that detect the actuation travel, with any other actuating elements, for example roller tappets or levers, are conceivable. Electro-mechanical switch elements or also semiconductor-based switch elements, such as Hall sensors, can be used.

The switch elements 7 are arranged in or on carriages 9, which in turn are held in a suitable manner, not shown here, on sliding plates 10 connected to the housing in such a way that they can be moved parallel to the axis of the camshaft 3 and can be fixed in any desired position. Suitable means of holding them, not shown in the figure, are, for example, screw-clamp connections.

The contour of the three-dimensional cam 4 is selected in such a way that, by moving the carriages 9 with the switch elements 7, the angle of the roller lever 5 mentioned hereinafter as the switching angle, at which the respective actuating element 8 is actuated in one direction or the other from the corresponding cam flank 11 beyond the switch point of the corresponding switch element 7, can be adjusted as desired. As an adjustment aid, the three-dimensional cam 4 can be provided with a scale 14 for this purpose, the values of which are characteristic for the switching angles resulting from it.

Figure 2:
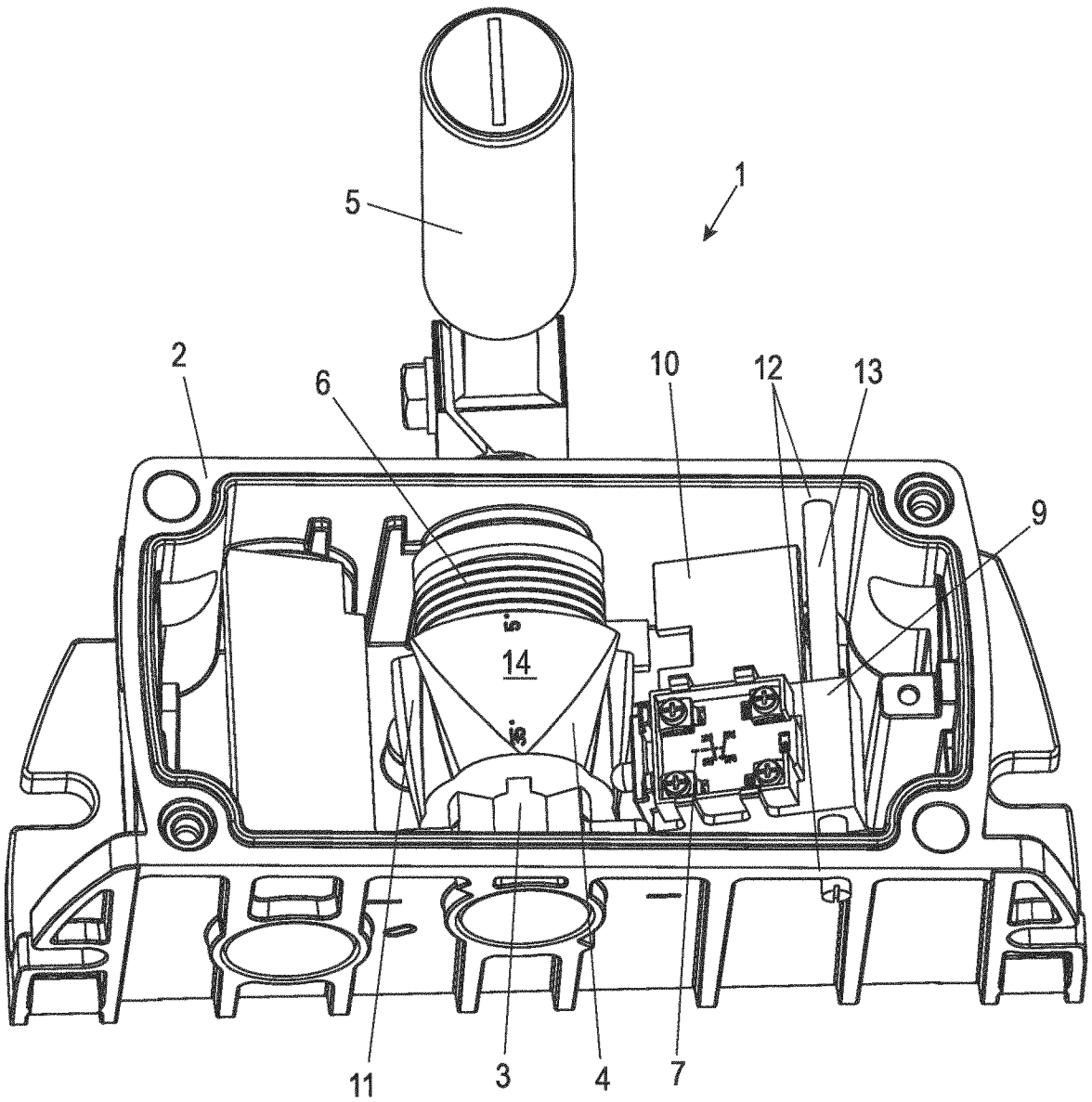
FIG. 2 shows a belt misalignment switch in a second embodiment example of the invention with adjustment possibility from outside.

FIG. 2 shows another belt misalignment switch 1 as a second embodiment example of a switch device. In this embodiment example, identical reference numerals indicate identical or equally effective elements as in the first embodiment example.

In contrast to the first embodiment example, the housing 2 of the belt misalignment switch 1 of FIG. 2 has holes 12 to accommodate an adjusting shaft 13. The adjusting shaft 13 can be a threaded rod, a worm shaft or a similar element suitable for adjustment, which is rotatably mounted in a suitable manner in the housing 2 and which can be actuated in the direction of rotation directly from the outside, for example via an integrally formed crank, or by means of an auxiliary means, for example a screwdriver. The rotary motion of the adjusting shaft 13 is transmitted via its thread, worm or the like to the carriage or carriages 9, which are designed as counterpart(s) and can then be moved in the axial direction of the camshaft 3. The carriages 9 can be used to move the switch elements 7 accordingly into a position in which they are shifted to the desired switching angle.

Figure 3:
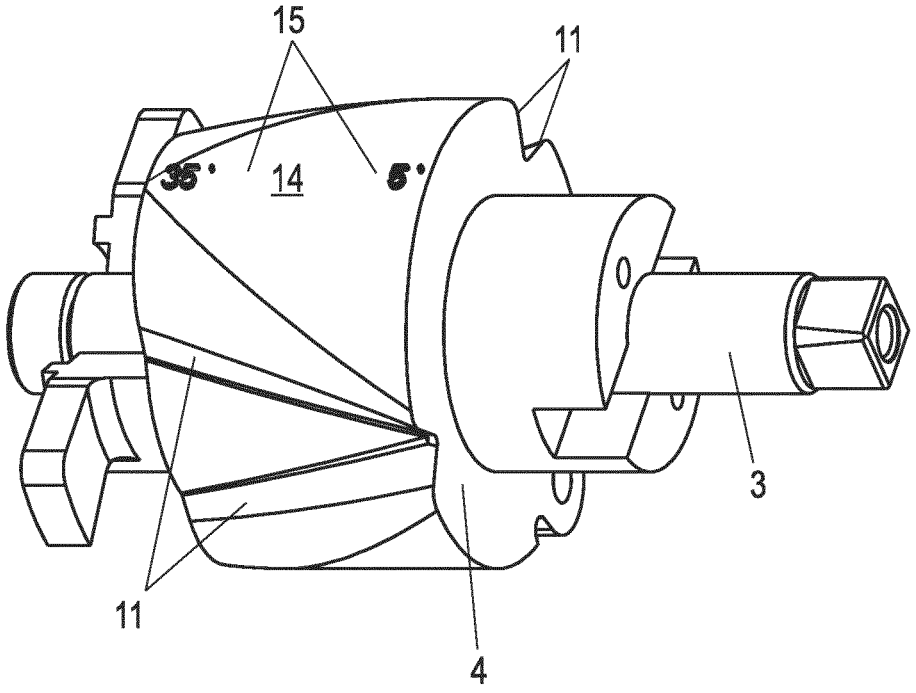
FIG. 3 shows the camshaft used in the embodiment examples in FIGS. 1 and 2 including the three-dimensional cams.

In FIG. 3 the camshaft 3 of the belt misalignment switches 1 of FIGS. 1 and 2 together with the three-dimensional cams 4 are shown separately. In the example shown here, cam flanks 11 of the three-dimensional cam 4 show a course which corresponds to a linearly extending change of the switching angle between the ends of the adjustment range. Within the scope of geometric feasibility, however, any other desired course of the cam flanks 11 is also possible. It is also possible to adjust the operating behavior of the switch elements via a curve of the cam height not shown here and the resulting variable stroke of the actuating elements. Likewise, the switching angle end values 15 shown here on a scale 14 should be regarded as an example. Any other end values are also possible within the scope of geometric feasibility. Furthermore, it is possible to apply further switching angle values beyond the end values shown here or to select a completely different suitable form of scale representation.

Figure 4:
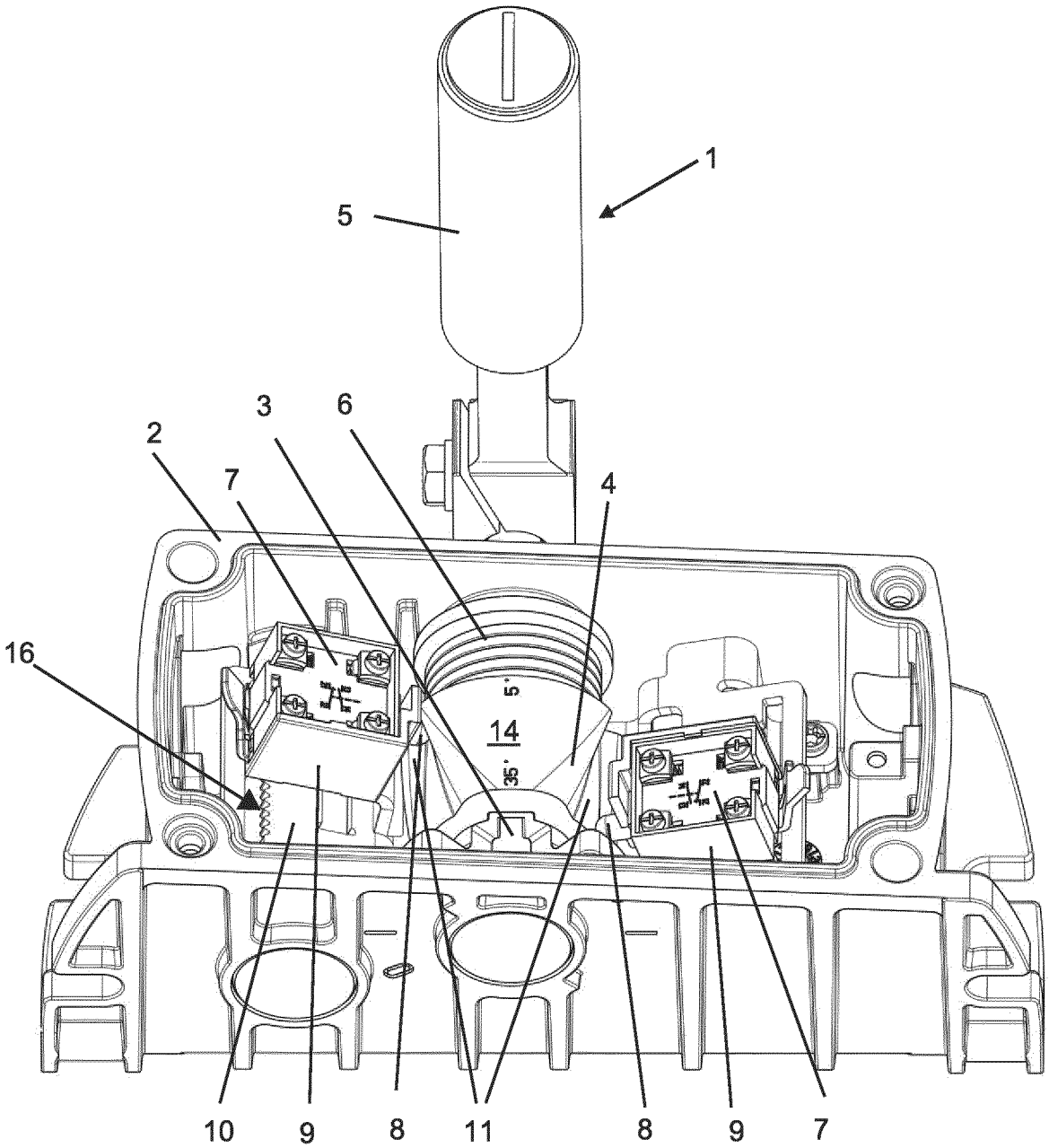
FIG. 4 shows a third embodiment example of a belt misalignment switch.

FIG. 4 shows another embodiment example of a belt misalignment switch 1 with a camshaft 3 with three-dimensional cams 4. Again, the same reference numerals in this embodiment example indicate the same or equally effective elements as in the first two embodiment examples. In its basic structure, the third embodiment example corresponds to the two previous embodiment examples. The description of the first two examples is explicitly referred to here. The camshaft 3 shown in FIG. 3 can also be used here. The differences to the first two examples are explained below.

In the present embodiment example, the carriages 9 are adjustable and designed as latching carriages. They are also referred to as latching carriages 9 in the following. It is understood that it can also be provided that only one of the two carriages 9 is designed as such a latching carriage.

Figure 5:
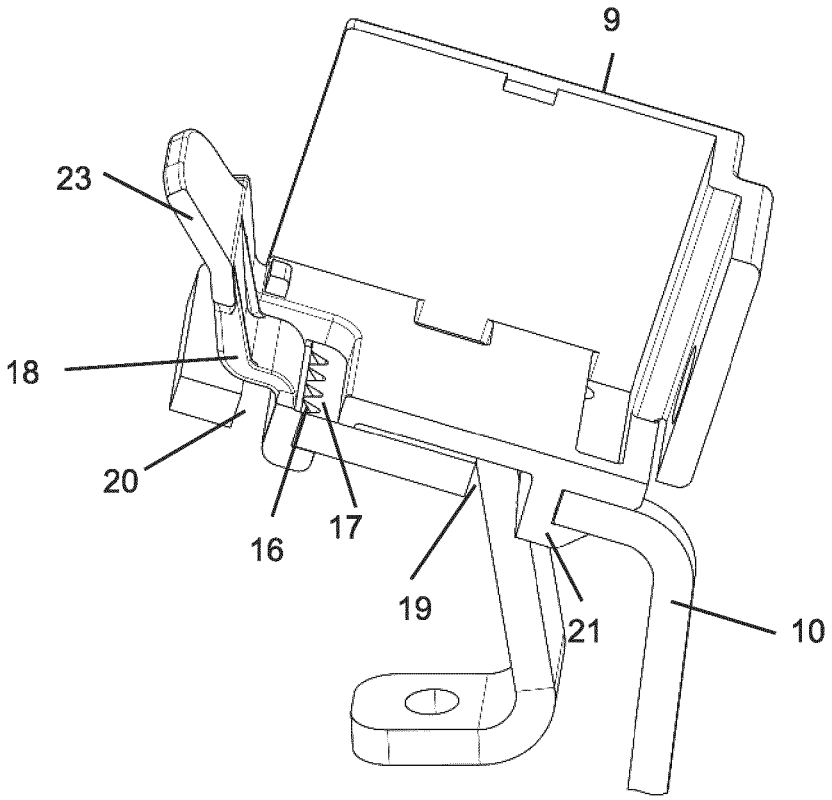
FIG. 5 shows a section through a part of a sliding plate and a latching carriage of the embodiment example in FIG. 4.

FIG. 5 shows the arrangement of the latching carriage 9 on a sliding plate 10, which has a guide slot 19 and a latching slot 20 with a toothing, hereinafter referred to as plate toothing 17, wherein the slots 19 and 20 extend essentially parallel to the axis of the camshaft 3. The latching carriage 9 is guided by a hook-shaped guide element 21 in a direction perpendicular to the sliding plate 10 and in one of the directions perpendicular to the guide slot 19 and parallel to the sliding plate 10. At its end opposite the guide element 21, the latching carriage 9 is held in the direction perpendicular to the sliding plate 10 and parallel to the latching slot 20 by a latching element 18 provided with a toothing, hereinafter referred to as carriage toothing 16, which is hook-shaped at its lower end. The latching carriage 9, and with it the corresponding switch element 7, can be moved parallel to the camshaft 3 by disengaging the toothing 16 and 17 with the aid of a release element 23. The switching angle is set to a desired value by moving the latching carriage 9. When the toothings 16 and 17 engage, the latching carriage 9 is fixed in position and the set switching angle is fixed.

In the example shown, the latching carriage 9 is mounted on the sliding plate 10 in such a way that the guide element 21 is first passed through the guide slot 19 and the latching carriage 9 is then moved perpendicular to the camshaft axis in such a way that the guide element 21 engages under the sliding plate 10. The latching element 18 is then deflected by actuating the release element 23 in such a way that the hook-shaped lower end of the latching element 18 can be guided through the latching slot 20 in a hinge-like pivoting movement of the latching carriage 9 around the guide element 21. The release element 23 is then released, whereby the deflection of the latching element 18 is terminated, the latching element 18 engages under the sliding plate 10 and the carriage toothing 16 engages in the plate toothing 17.

Figure 6:
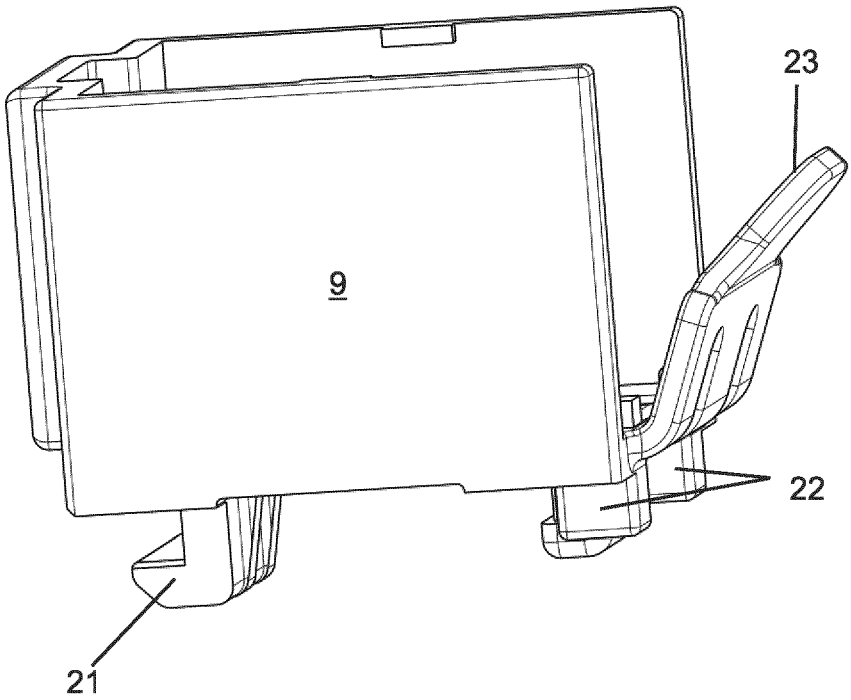
FIG. 6 shows a latching carriage of the embodiment example in FIG. 4.

FIG. 6 illustrates the guide pins 22 which, with the latching carriage 9 mounted, rest against the side of the latching slot 20 opposite the plate toothing 17 and guide the latching carriage in the direction perpendicular to the latching slot 20, facing away from the plate toothing 17 and parallel to the sliding plate 10, and thus in the other direction perpendicular to the guide slot 19 and parallel to the sliding plate 10.

Figure 7:
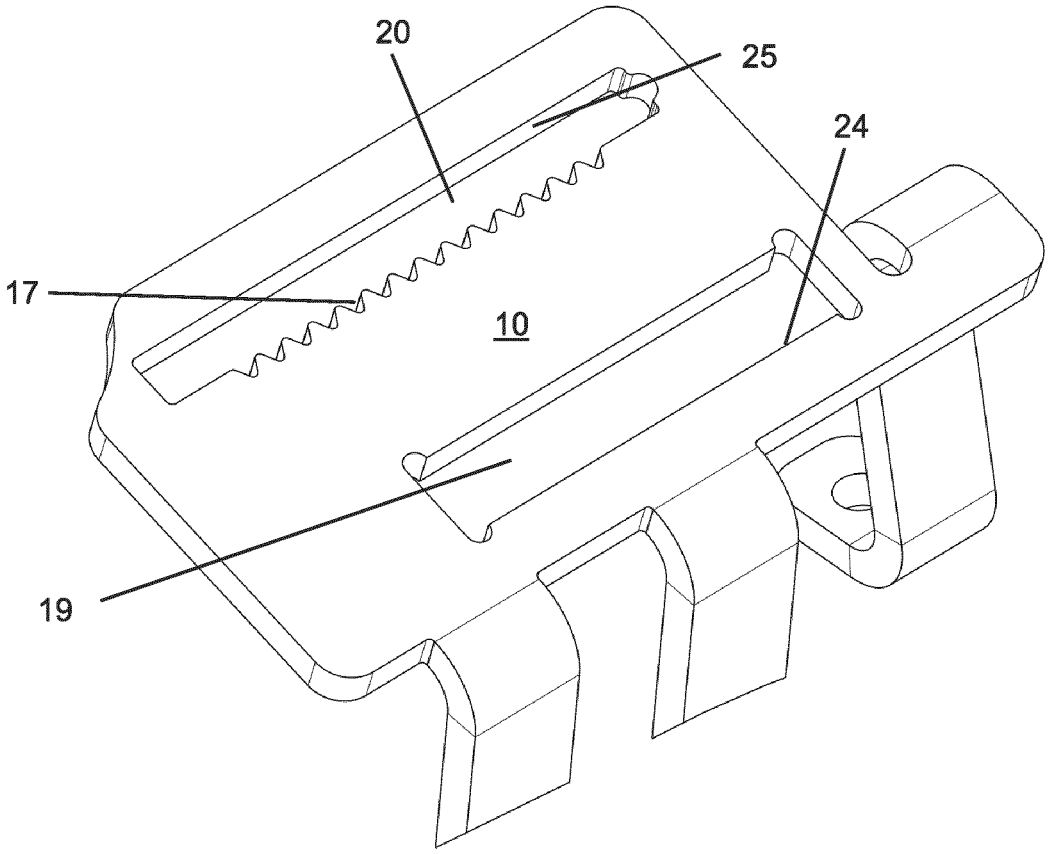
FIG. 7 shows a partial view of the sliding plate of the embodiment example in FIG. 4.

FIG. 7 shows a partial view of the sliding plate 10 with the guide slot 19 and the latching slot 20 including plate toothing 17. In the assembled state of the latching carriage 9, the plate toothing 17 with the carriage toothing 16, a guide slot guide flank 24 with the guide element 21, a latching slot guide flank 25 with the guide pins 22, the latching element 18 and the guide element 21 interact with the underside of the sliding plate 10 as well as the underside of the latching carriage 9 in such a way that essentially a positive positioning of the latching carriage 9 is achieved.

Figure 8:
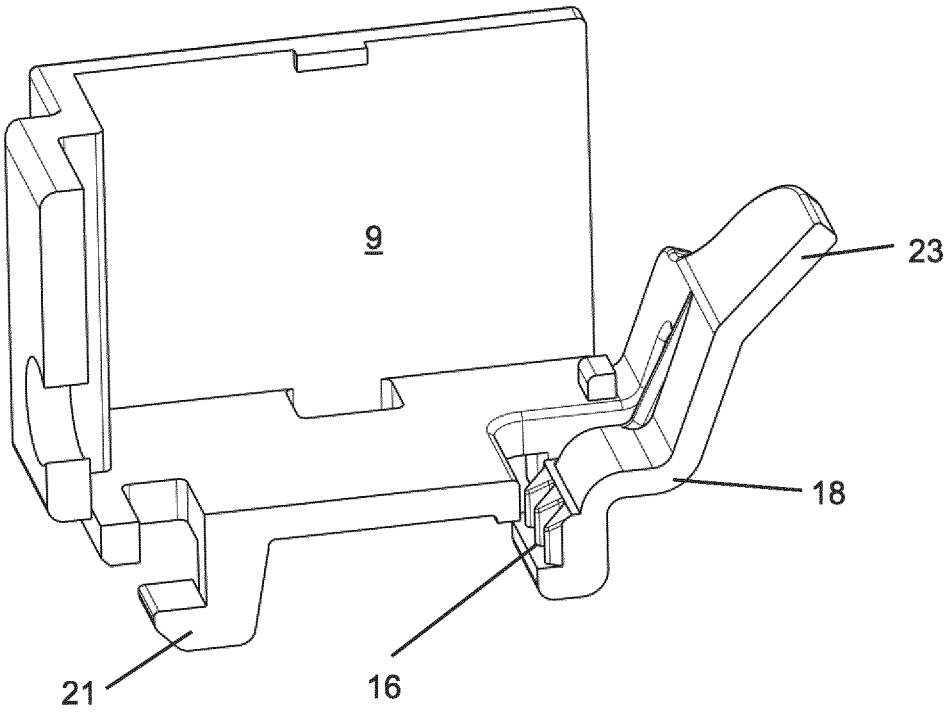
FIG. 8 shows a section through a latching carriage of the embodiment example in FIG. 4.

FIG. 8 shows an embodiment of the latching carriage 9 with the guide element 21, the guide pin 22 (not visible here) and the latching element 18. The latching element 18 comprises the carriage toothing 16 and the release element 23. The integral design of the latching carriage 9 shown here is made possible by the use of a suitably elastic material, which on the one hand has an overall sufficient strength and rigidity, and on the other hand, if the connection of the latching element 18 is suitably designed, allows its elastic, self-resetting deflection.

The average person skilled in the art will understand that other embodiment examples of the invention are also possible without leaving the scope of the present invention. In particular, a multi-part embodiment of the latching carriage and other designs and arrangements of latching and guidance are possible.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Belt misalignment switch
2 Housing
3 Camshaft
4 Three-dimensional cam
5 Roller lever
6 Return spring
7 Switch element
8 Actuating element
9 Carriage (latching carriage)
10 Carriage plate
11 Cam flank
12 Hole
13 Adjusting shaft
14 Scale
15 Switching angle end value
16 Carriage toothing
17 Plate toothing
18 Latching element
19 Guide slot
20 Latching slot
21 Guide element
22 Guide pin
23 Release element
24 Guide slot guide flank
25 Latching slot guide flank

The invention claimed is:

1. A switch device, comprising:

a camshaft comprising a cam; and at least one switch element configured to be actuated by the cam of the camshaft, wherein the at least one switch element is arranged so as to be displaceable parallel to an axis of the camshaft to adjust a switch point of the switch device, wherein the cam is a three-dimensional cam having a cross-section that changes in an axial direction of the camshaft, wherein displacing the at least one switch element parallel to the axis of the camshaft adjusts the switch point of the switch device based on a position of the at least one switch element relative to the changing cross-section of the three-dimensional cam.

2. The switch device of claim 1, further comprising:

a carriage, wherein the at least one switch element is mounted on or integrally connected to the carriage to allow the displacement parallel to the axis of the camshaft.

3. The switch device of claim 2, further comprising:

a housing; and adjusting means arranged in the housing, wherein the adjusting means is configured to directly or indirectly adjust the switch point of the switch device from outside of the housing.

4. The switch device of claim 3, wherein the adjusting means are one or more adjusting shafts mounted in the housing, guided at least at one end through an opening in a wall of the housing, aligned substantially parallel to the axis of the camshaft, and each provided with a thread or a thread-like contour, wherein the thread or the thread-like contour is in engagement with a corresponding counter-contour in the carriage, and wherein rotation of the one or more adjusting shaft causes the carriage to be displaced.

5. The switch device of claim 2, wherein the at least one switch element is fixed in a releasable latching manner after the switch point has been set.

6. The switch device of claim 5, wherein the carriage is a latching carriage configured to enable displacement parallel to the axis of the camshaft and configured for releasable latching fixing.

7. The switch device of claim 6, wherein the carriage mountable in and removable from the switch device without tools.

8. The switch device of claim 6, wherein the carriage has a latching element, which has a carriage toothing engaging in a plate toothing.

9. The switch device of claim 7, wherein the carriage is a single piece construction.

10. The switch device of claim 5, wherein the releasably latching and the parallel displacement of the switch element can be carried out without tools.

11. The switch device of claim 1, further comprising:

a scale configured for reading an expected switch point.

12. The switch device of claim 1, further comprising:

a lever coupled in a rotationally fixed manner to the camshaft for actuation.

13. The switch device of claim 12, wherein the lever is a roller lever.

14. The switch device of claim 12, wherein the switch device is a belt misalignment switch.

* * * * *